US007188578B2

(12) United States Patent
DeRosa

(10) Patent No.: US 7,188,578 B2
(45) Date of Patent: Mar. 13, 2007

(54) COVER PLATE REMOVAL TOOL

(76) Inventor: Robert James DeRosa, 3530 NE. 26th Ave., Lighthouse Point, FL (US) 33064

( * ) Notice: Subject to any disclaimer, the term of this patent is extended or adjusted under 35 U.S.C. 154(b) by 221 days.

(21) Appl. No.: 11/092,246

(22) Filed: Mar. 29, 2005

(65) Prior Publication Data

US 2006/0219147 A1 Oct. 5, 2006

(51) Int. Cl.
*B63B 19/12* (2006.01)
*B65D 45/00* (2006.01)
*E05B 65/00* (2006.01)

(52) U.S. Cl. ..... 114/203; 220/315; 49/35

(58) Field of Classification Search ..... 114/203
See application file for complete search history.

(56) References Cited

U.S. PATENT DOCUMENTS 1,610,123 A * 12/1926 Fairweather ..... 49/35
4,354,445 A 10/1982 Kafka et al.

* cited by examiner

*Primary Examiner*—Jesús D. Sotelo
(74) *Attorney, Agent, or Firm*—Melvin K. Silverman; Yi Li

(57) ABSTRACT

A cover plate removal tool including an elongate solid unit having a hollow longitudinal track having an end portion including a cylindrical recess having an axis transverse to a longitudinal axis of said track. The cover plate removal tool also includes a plurality of solid pegs securable perpendicular within said track. The pegs are slidable back and forth within said track. The removal tool includes a solid cylindrical element having a lower portion proportioned to fill said cylindrical recess and further proportioned for complemental fit within said track.

7 Claims, 4 Drawing Sheets

COVER PLATE REMOVAL TOOL

BACKGROUND OF THE INVENTION

1. Area of Invention

The present invention relates to cover plates, deck plates and the like.

2. Prior Art

The present invention relates generally to removable cover plates, including in the deck of boats, more particularly threaded cover plates which can be readily installed or removed to provide quick access to areas below the deck such as a storage space, the bilge, and areas where shut-off valves, instruments, and the like are located.

Generally, the presence of sand and salt crystals affects the seal and removal of conventional deck plates and cover plates making it difficult to remove manually. Thus, removal of the deck plate with one's hand often times is difficult or awkward.

The prior art includes a lift ring device, U.S. Pat. No. 4,354,445 to Kafka et al., for installation in the forward portion of the deck of a boat or other item that may need from time to time to be lifted. The current market includes deck plate keys for use in opening up fuel tanks and water tanks, but these keys are manufactured to fit very small sized filler caps and are often made of metal or nylon.

It would be desirable to provide a cover plate removal tool for opening various sizes of cover plates for quick access to the areas beneath the deck.

SUMMARY OF THE INVENTION

A tool for removal of a circular deck cover plate including an elongate solid unit including a hollow longitudinal track having an end portion including a cylindrical recess having an axis transverse to a longitudinal axis of said track. The cover plate removal tool also includes a plurality of solid pegs securable perpendicularly within said track. The pegs are slidable back and forth within said track. The removal tool includes a solid cylindrical element having a lower portion proportioned to fill said cylindrical recess and further proportioned for complemental fit within said track.

It is accordingly an object of the invention to provide a tool for quick and efficient access to areas beneath a deck of a marine vessel.

Another object of the invention is to provide a buoyant tool for removal of deck plates on power boats, sailboats, and the like.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
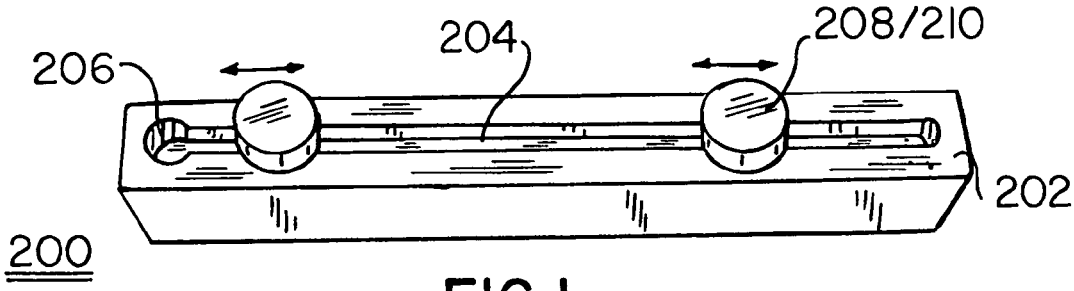
FIG. 1 is a perspective top view of the cover plate removal tool.
Figure 2:
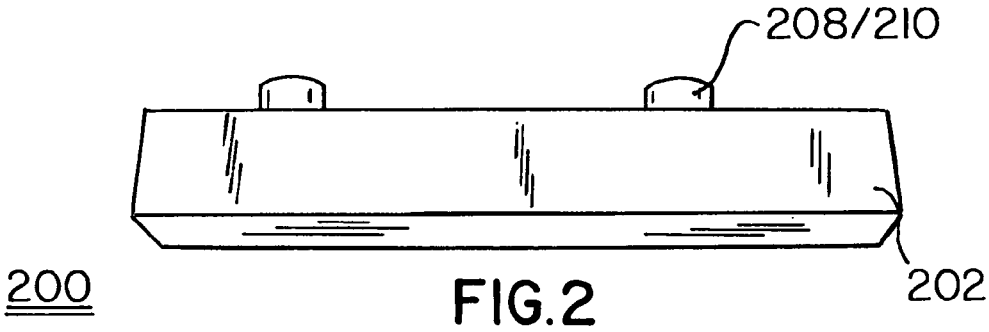
FIG. 2 is a perspective side view of the cover plate removal tool.

With reference to FIGS. 1 and 2, there is shown, in perspective view a cover plate removal tool 200. In FIGS. 1 and 2 may also be seen an elongate solid unit 202 which includes a hollow longitudinal track 204 having an end portion including a cylindrical recess 206 having an axis transverse to a longitudinal axis of said track 204. It should be noted that a cover plate includes a deck plate on a marine vessel.

Figure 3:
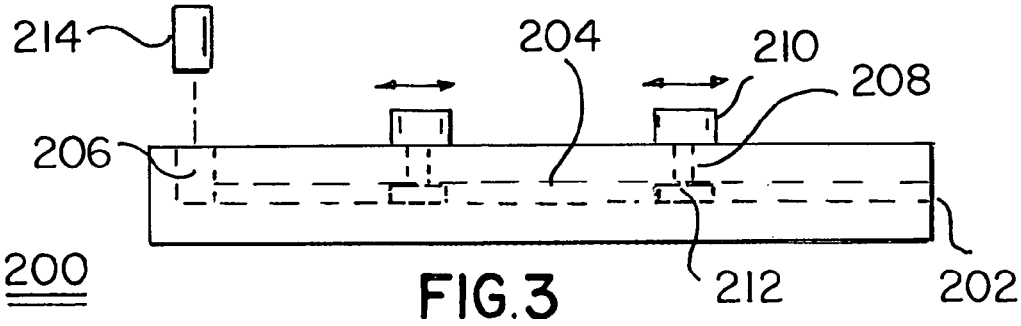
FIG. 3 is a perspective view of the inside of the cover plate removal tool showing the directional movement of the pegs.

As shown in FIG. 3, a plurality of solid pegs 208 are securable perpendicularly within said track 204. The plurality of solid pegs 208 are slidable back and forth within said track 204. There is also shown a solid cylindrical element 214 proportioned to having a lower portion proportioned to fill the cylindrical recess 206 and further proportioned to fit within said track. The cylindrical element 214 is placed in the cylindrical recess 206 in order to maintain the pegs 208 within the track 204. The cover plate removal tool 200 may include a plurality of recesses and a corresponding plurality of cylindrical elements.

Figure 4:
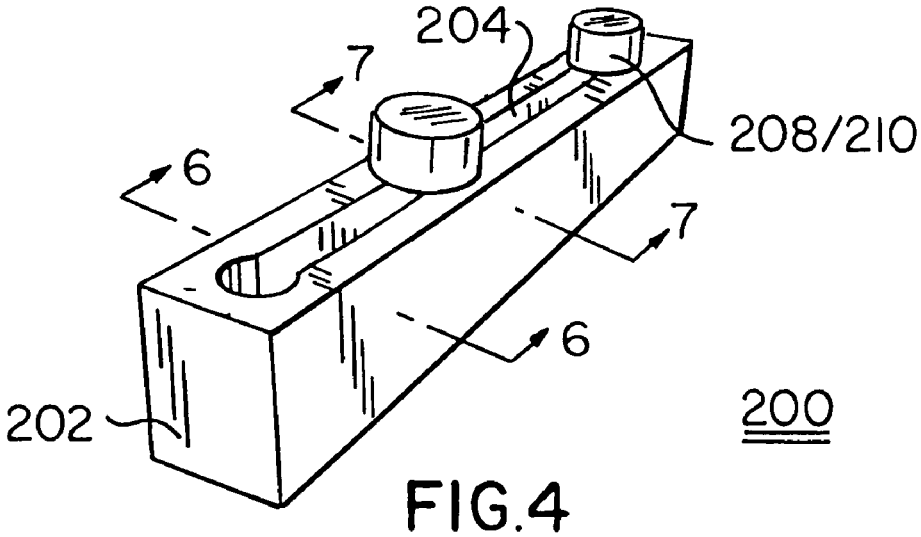
FIG. 4 is a perspective view of the cover plate removal tool.
Figure 5:
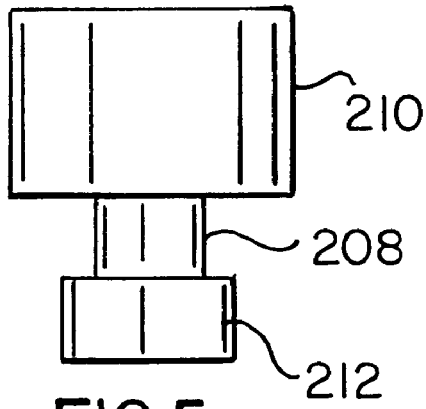
FIG. 5 is an enlarged perspective view of a single peg.
Figure 6:
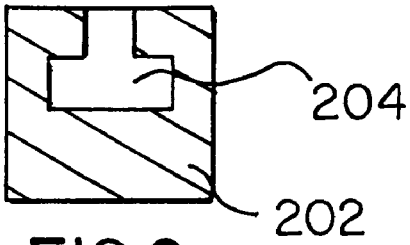
FIG. 6 is a perspective inside view of the track of the cover plate removal tool without the peg.
Figure 7:
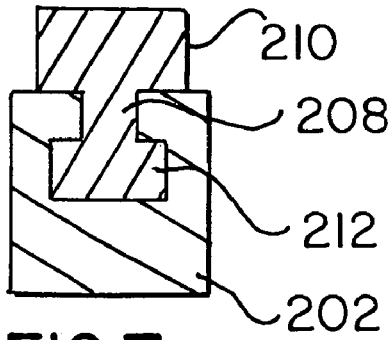
FIG. 7 is a perspective inside view of the track of the cover plate removal tool with the peg.

Shown in FIGS. 4 and 5, the plurality of pegs includes an upper portion 210. The upper portion 210 can be used to maneuver the pegs 208 within the track 204. One can use the upper portion 210 of the pegs 208 to grip as one slides the pegs 208 back and forth in said track 204. The upper portion 210 of the pegs 208 can be moved back and forth to fit the various sizes of deck plates 102. FIGS. 5 and 7 show the lower portion 212 which slides back and forth within said track 204. The lower portion 212 is proportioned to fit within the track 204 and allow slidable movement within the track 204 (See FIGS. 6 and 7). The lower portion 212 is also proportioned so that when one is not sliding the upper portion 210 of the pegs 208, the pegs 208 remain in place.

Figure 8:
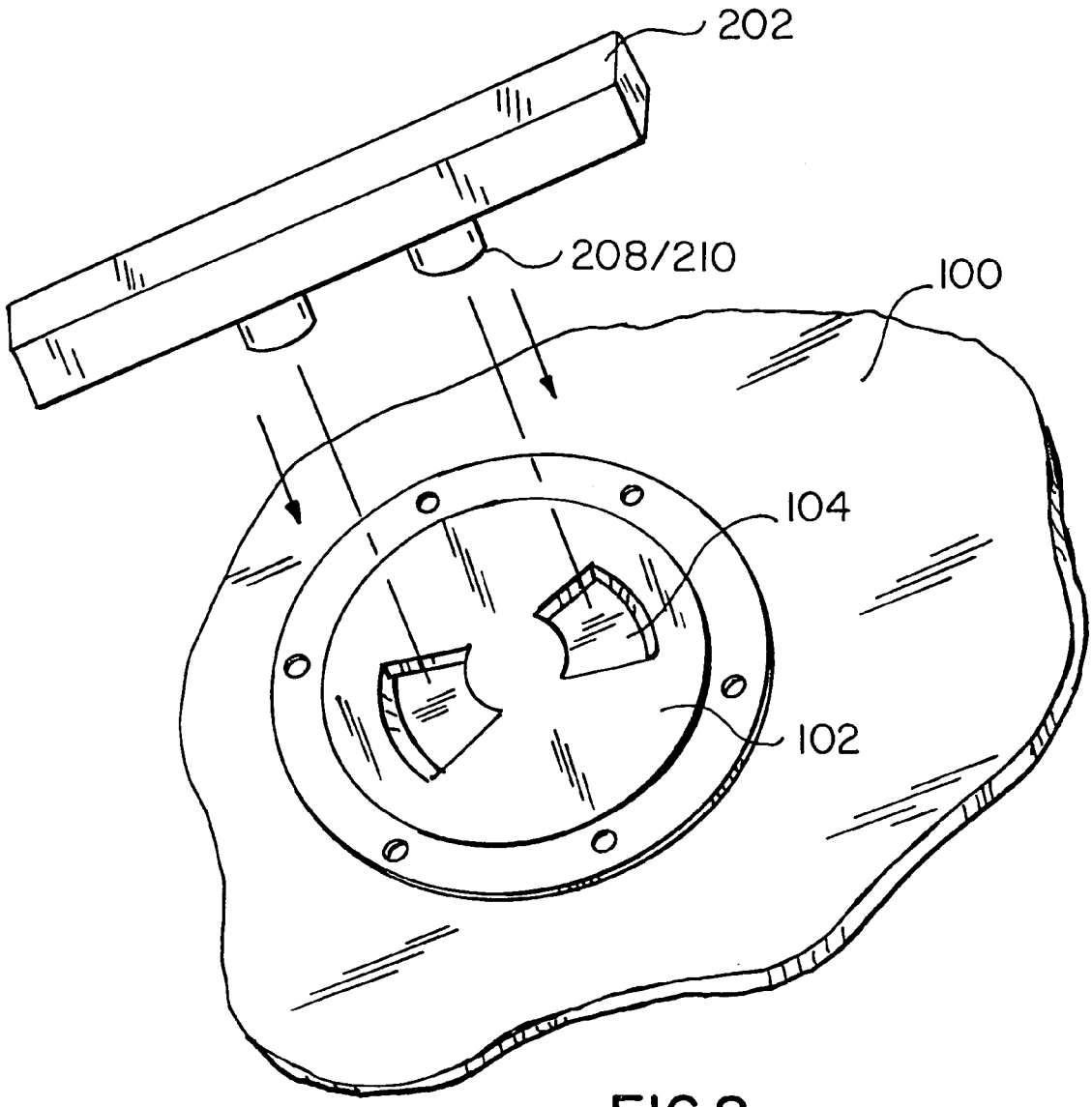
FIG. 8 is a depiction of the cover plate removal tool in use to remove a deck plate.
Figure 9:
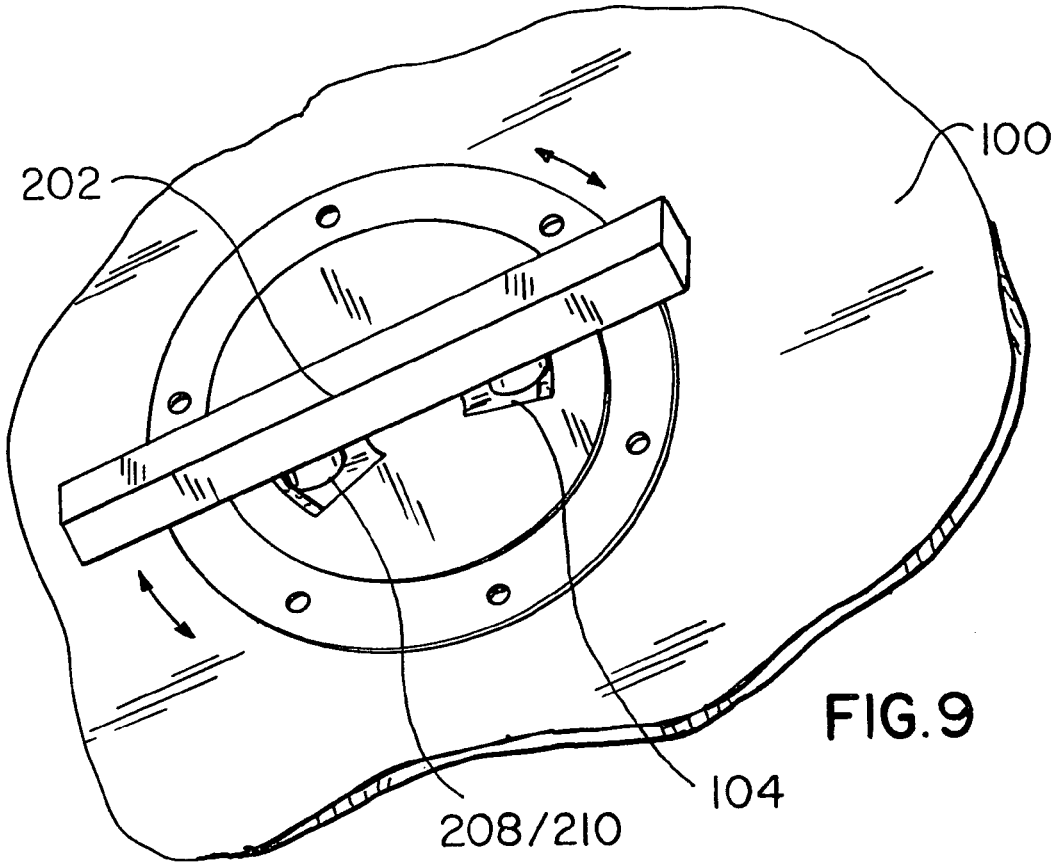
FIG. 9 is a view of the cover plate tool in contact with the deck plate and the rotational movement used to remove the deck plate.
Figure 10:
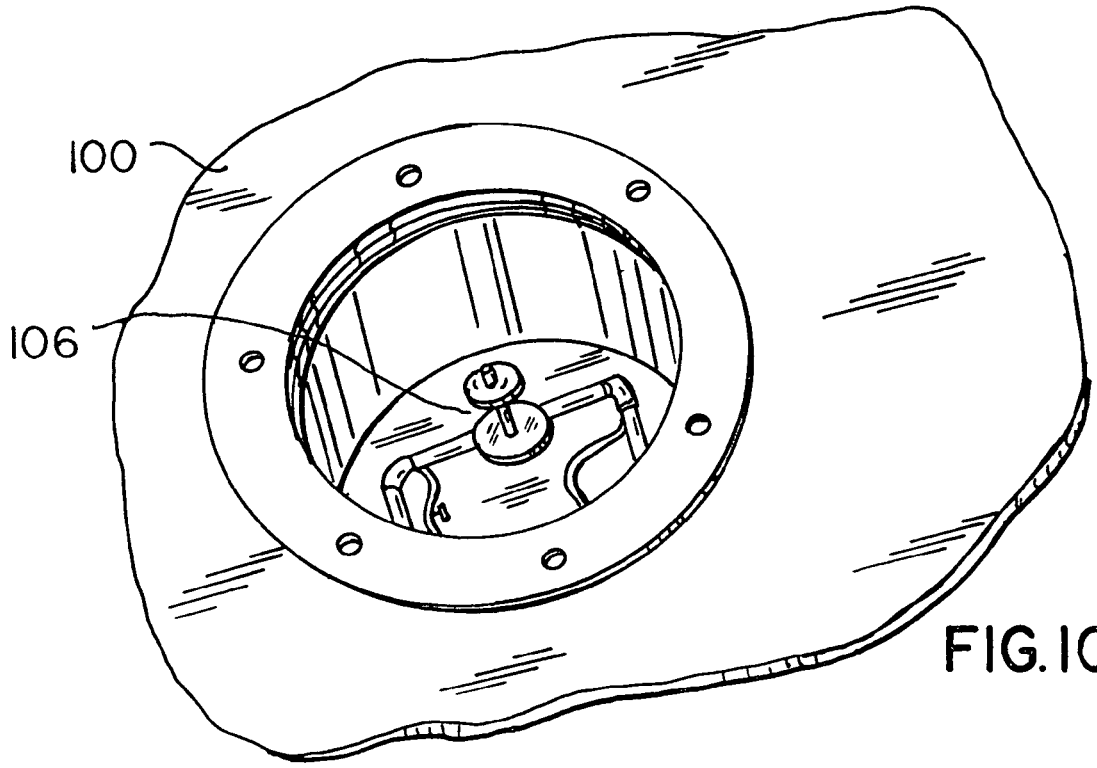
FIG. 10 is a view of the inside of an inspection area below deck once the deck plate has been removed.

FIGS. 8–10 show the use of the cover plate removal tool 200. In FIG. 8 is shown the upper portion 210 of the pegs 208 aligned with the openings 104 in the cover plate 102 mounted within the deck 100 of a boat. FIG. 9 shows the clockwise rotational movement of the cover plate tool 200 using the elongate solid unit 202 as a handle. In FIG. 10 the cover plate 102 has been removed from the deck 100 allowing access to inspect areas 106 below deck.

The elongate solid unit 202 is preferably comprised of a marine grade polymer such as King Starboard® which is durable and can resist harsh sun and sea conditions including ultraviolet rays. The use of King Starboard® for the elongate solid unit 202 also allows the cover plate tool 200 to be buoyant allowing a clear advantage for use in the marine environment. The elongate solid unit may also be comprised of an alternative material such as another polymer, wood, or the like.

The elongate solid unit 202 defines a longitudinal length of about 6 to about 8 inches. The track 204 including the cylindrical recess 206 defines a longitudinal length of about 5 to about 7 inches. The diameter of the cylindrical recess is preferably about ½ to about ¾ inches. The unit exhibits a width of about 0.5 to about 2 inches. The height of the elongate solid unit 202 is about 1 to about 1.5 inches.

The pegs 208, the upper portion 210, the lower portion 212, and the cylindrical element 214 are preferably made of polyoxymethylene, such as Delrin®. These components may also be made of an alterative polymer or other material which can be used for long term mechanical stability such as use in fittings and threaded adapters. The pegs 208, upper portion 210, and lower portion 212, like the elongate solid unit 202, may also comprise any buoyant material having functional rigidity. The upper portion 210 of the pegs 208 defines a diameter of about ¾ to about 1 inch. The lower portion 212 of the pegs 208 exhibits a diameter of ½ to about ¾ inches.

While there has been shown and described the preferred embodiment of the instant invention it is to be appreciated that the invention may be embodied otherwise than is herein specifically shown and described and that, within said embodiment, certain changes may be made in the form without departing from the underlying ideas or principles of this invention as set forth in the Claims appended herewith.

What is claimed is:

1. A cover plate removal tool, comprising:

(a) an elongate solid unit including a hollow longitudinal track having an end portion including a cylindrical recess having an axis transverse to a longitudinal axis of said track;

(b) a plurality of solid pegs securable perpendicularly within said track, said pegs slidable back and forth within said track; and (c) a solid cylindrical element having a lower portion proportioned to fill said cylindrical recess and further proportioned for complemental fit within said track.

2. The cover plate removal tool as recited in claim 1, in which said plurality of pegs include an upper portion.

3. The cover plate removal tool as recited in claim 1, in which said plurality of pegs include a lower portion slidable back and forth within said track.

4. The cover plate removal tool as recited in claim 1, in which said cylindrical recess includes a plurality of recesses and a corresponding plurality of solid cylindrical elements.

5. The cover plate removal tool as recited in claim 1, in which said plurality of solid pegs each comprise a buoyant material.

6. The cover plate removal tool as recited in claim 1, in which the solid elongate unit comprises a buoyant material.

7. The cover plate removal tool as recited in claim 1, in which said cover plate comprises a deck plate.

* * * * *